United States Patent [19]

Thompson

[11] Patent Number: 4,996,674

[45] Date of Patent: Feb. 26, 1991

[54] DOUBLE PISTON ACOUSTIC TRANSDUCER WITH SELECTABLE DIRECTIVITY

[75] Inventor: Stephen C. Thompson, Euclid, Ohio

[73] Assignee: Westinghouse Electric Corp., Pittsburgh, Pa.

[21] Appl. No.: 135,477

[22] Filed: Dec. 21, 1987

Related U.S. Application Data

[63] Continuation of Ser. No. 745,184, Jun. 14, 1985, abandoned.

[51] Int. Cl.[5] ..... H04R 17/00; H04R 17/10

[52] U.S. Cl. ..... 367/158; 310/325; 310/321

[58] Field of Search ..... 367/158; 310/325, 326, 310/321

[56] References Cited

U.S. PATENT DOCUMENTS 3,974,474 8/1976 Izzo ..... 367/158

FOREIGN PATENT DOCUMENTS 1513530 6/1978 United Kingdom ..... 367/158

OTHER PUBLICATIONS

Ding, "Computerized Sonar Transducer Analysis and Design Based On Multiport Network Interconnection Techniques", Apr. 1973, pp. 1-32.

Camp, "Underwater Acoustics," 1970, pp. 142-150.

*Primary Examiner*—Ian J. Lobo

*Attorney, Agent, or Firm*—D. Schron

[57] ABSTRACT

A direction selective transducer which includes a center mass fixed between two active transducer element stacks and two head masses. The center mass couples the two stacks and allows the ratio of radiation produced by each head mass to be selected as desired by varying the amplitude and phase of drive voltages applied to the stacks. The transducer can also be used as a directional receiver.

11 Claims, 5 Drawing Sheets

DOUBLE PISTON ACOUSTIC TRANSDUCER WITH SELECTABLE DIRECTIVITY

This is a continuation of co-pending application Ser. No. 745,184 filed on June 14, 1985 now abandoned.

BACKGROUND OF THE INVENTION

1. Field of the Invention

The present invention relates to an electromechanical transducer and, more particularly, to a transducer type commonly known as a double piston transducer in which energy can be selectively radiated from opposite ends of the transducer device.

2. Description of the Related Art

A device commonly known as a double piston transducer is an electromechanical or electroacoustical transducer known in the prior art. In its simplest form the device consists merely of a thin piece of active material in contact with a radiating medium on both sides and which can be driven electrically to induce a planar motion therein. For example, a flat disk or ring made of piezoelectric ceramic (such as a lead zirconate titanate formulation) which has electrodes on its flat faces and is polarized in the direction normal to the flat surfaces may act as such a vibrator. This type of device is commonly operated at frequencies near its first longitudinal resonance frequency to achieve a higher output. To achieve a reasonably low resonance frequency and a well controlled response in a compact device, it is common practice to mass load the two sides of the active material with inactive material pieces.

An example of a prior art mass loaded double piston transducer is shown in FIG. 1(*a*). Piezoelectric material rings 1 are bonded to form a composite piezoelectric stack 2 and electrically wired in parallel so that when a voltage is applied between the electrical loads, all of the individual rings 1 expand or contract in unison along the longitudinal axis of the device. At each end of the ceramic stack are bonded identical head mass elements 3 each having an outer face 4 which is in contact with the radiating medium 5. A stress rod or pretension bolt 6 and an associated nut 7 are used to join the components and to provide a compressive bias stress to the stack 2 of active elements. For simplicity of explanation the electrodes which are positioned between the rings 1, and the insulating washers which are positioned at the ends of the stack 2 of rings are not shown. Such details are within the knowledge of the ordinarily skilled in the art.

The device of FIG. 1(*a*) may be used as either a generator or receiver of mechanical or acoustic energy and is normally operated in a frequency band approximately centered on its primary resonance frequency. In this frequency band the two head masses 3 move in opposite relative directions while the stack of active material 2 alternately expands and contracts along its length.

It will be recognized by those of ordinary skill in the art that the performance of the device in FIG. 1(*a*) can be approximated by the analogous behavior of the simplified electrical equivalent circuit of FIG. 1(*b*). In the circuit, the two inductors $m_h$ represent the two head masses, and the compliance of the ceramic stack is represented by the capacitor C. The two inductors $m_{e1}$ and $m_{e2}$ represent the effective mass contribution of the two ends of the ceramic stack 2. $C_0$ is the electrical clamped capacitance of the ceramic stack 2, and $\emptyset$:1 is the transformation ratio of the electromechanical transformer representing the transduction property of the piezoelectric stack 2. The open boxes in the outer legs of the equivalent circuit represent the equivalent radiation impedance $Z_{rad}$ seen by the radiating faces of the transducer. The equivalent currents $u_1$ and $u_2$ in these impedances represent the velocities of the moving faces of the transducer.

Because of the symmetry of the device of FIG. 1(*a*) the energy radiated from its two ends is equal. In the equivalent circuit representation, this symmetry makes it evident that the equivalent currents $u_1$ and $u_2$ are equal. In an acoustic device this means that sound energy is radiated equally to the far field in both directions along the longitudinal axis of the device. In some applications this is advantageous. However, in other applications it is necessary to employ a device which can radiate in either direction along the longitudinal axis without significant radiation in the other direction. In these applications, the prior art double ended longitudinal vibrator is not acceptable.

In an application requiring unidirectional radiation, it is possible to employ two separate devices each having only a single radiating face in contact with the medium 5. Such an arrangement is shown in FIG. 2(*a*) where two identical longitudinal vibrator devices are mounted back to back. Each of these devices is similar to the double ended radiator except that it has only one head mass 3 in contact with the radiating medium. The second head mass is replaced by a tail mass 8 which is free to vibrate. The electrical equivalent circuits for this pair of devices are shown in FIG. 2(*b*). Each of the two circuits is similar to the one circuit of FIG. 1(*a*) except for the replacement of one of the two equivalent head mass inductors $m_h$ by the equivalent inductance of the tail mass $m_t$, and the elimination of the radiation impedance $Z_{rad}$ in series with this equivalent tail inductance.

The two transducers in this arrangement are separately driven, and each radiates in only one direction along their common longitudinal axis. In the equivalent circuit representation, it is evident that the equivalent currents $u_1$ and $u_2$ in the radiation impedances are completely independent. The two transducer arrangement is suitable for use in situations requiring unidirectional radiation. A disadvantage of this arrangement is that it is larger, heavier, more complex and more expensive than a single device which could fill the same function.

SUMMARY OF THE INVENTION

It is an object of the present invention to provide a double piston transmitting transducer and a method of electrically driving the transducer which together are capable of producing unidirectional radiation in either direction along the transducer longitudinal axis without significant radiation in the opposite direction.

It is another object of the present invention to produce a device capable of changing the direction in which the radiation is projected from one end to the other without moving or rotating the transducer.

It is an additional object of the present invention to provide a device capable of any desired ratio of the radiated energy in the two directions along its longitudinal axis by simply changing the parameters of the electrical signals to the device.

It is another object of the present invention to provide a double piston receiving transducer that can selectively have a high receiving signal sensitivity to signals arriving from one direction along its longitudinal axis and little or no sensitivity to signals arriving from the opposite direction.

It is still another object of the present invention to provide a device capable of changing the direction of high receiving sensitivity from one end to the other without moving or rotating the transducer.

It is another object of the present invention to provide a transducer and transducer control system capable of any desired ratio of the receiving sensitivity from the two directions along its longitudinal axis by simply changing the parameters of the electrical signals from the transducer.

It is still a further object of this invention to achieve the preceding objects in a relatively compact, lightweight and inexpensive device.

The present invention achieves the above objects by the addition of an extra mass placed in the center of the piezoelectric stack of a double piston transducer and appropriate electrical drive or receive circuitry connected to the two ceramic stacks thus created The extra mass divides the stack into two separate stacks which are not connected electrically, although the individual ceramic rings in each stack are electrically connected in parallel as in the prior art devices. By proper selection of the relative magnitude and phase of the drive voltage excitation applied to the two piezoelectric stacks, it is possible to achieve a broad range of acoustic performance characteristics.

These, together with other objects and advantages, which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1(*b*) is the equivalent circuit for the transducer of FIG. 1(*a*);

FIG. 2(*b*) is a pair of equivalent circuits for the transducers of FIG. 2(*a*);

FIG. 3(*b*) is the equivalent circuit for the transducer of FIG. 3(*a*);

FIG. 3(*c*) is the equivalent circuit of the device of FIG. 3(*a*) when driven to produce unidirectional radiation according to the method described herein;

DESCRIPTION OF THE PREFERRED EMBODIMENTS

Figure 1A:
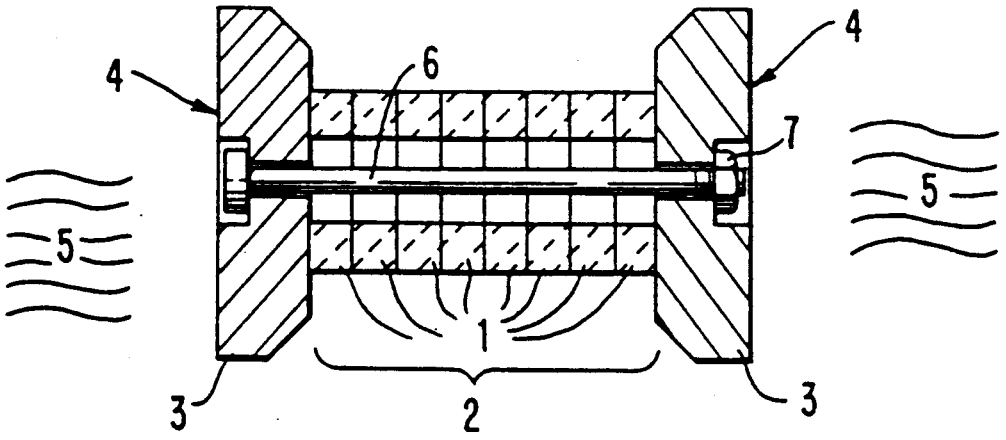
FIG. 1(*a*) depicts, in longitudinal cross section, the elements and construction of a prior art double ended longitudinal vibrator.
Figure 1B:
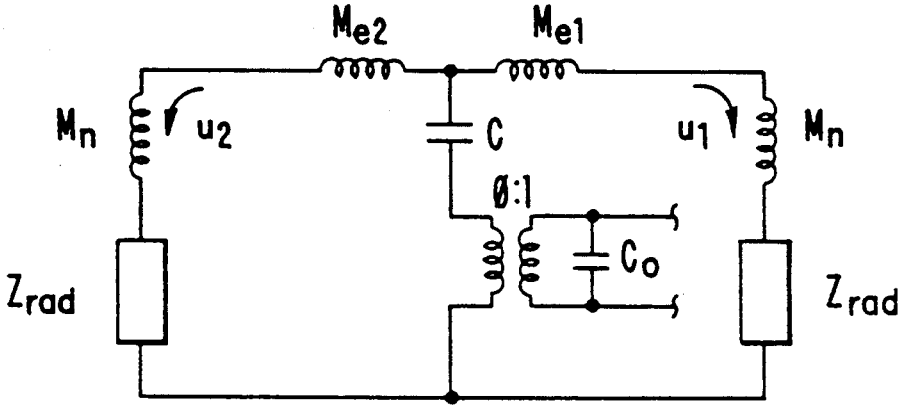

The present invention achieves selectable unidirectional response in a double piston transducer element by including an additional mass in the center of the piezoelectric stack, and by appropriate driving of the two ceramic stacks thus created. FIG. 3(*a*) illustrates a double ended transducer with an extra mass 9, which will hereafter be called the center mass. The center mass 9 is positioned between active transducer stacks 2' and 2'' and head masses 3' and 3''. The active stacks 2' and 2'' are compressively biased by stress rods 6' and 6'' and nuts 7' and 7''. The center mass 9 allows vibration to be transferred between the stacks 2' and 2'' and the masses 3' and 3'' respectively. The transferred vibration can enhance the vibration on the opposite side, nullify the vibration on the opposite side or any combination in between. The two head masses 3' and 3'' may be of identical construction as is the case for the head masses 3 of the prior art device, or they may be different to provide differing radiation properties to the two sides of the device. Likewise the two active stacks 2' and 2'' may be identical materials or they may be different to tailor the response in the two directions. The transducer of FIG. 3(*a*) is assembled in a manner substantially identical to the assembly of one of the prior art transducers of FIG. 2(*a*). The active transducer elements 1 can be piezoelectric elements manufactured from a piezoelectric ceramic material, such as a lead zirconate titanate formulation and can be obtained from Vernitron, Inc. in Bedford, Ohio. The head masses 3' and 3'' and center mass 9 can be tungsten, steel or aluminum. Stress rods 6' and 6'' can be a copper beryllium, one-quarter hard, alloy No. 172 in accordance with ASTM B-196 artificially aged to obtain Rockwell C39-42 after machining. The nuts 7' and 7'' can be of aluminum or steel, but mush have a flat surface against the head masses 3' and 3'' so that no rocking of the nuts occur. The entire transducer can be assembled either by using epoxy and then tensioning the stress rods 6' and 6'' or loosely assembled and held together by the stress rods 6' and 6''. The adjustment of the compressive bias using the stress rods 6' and 6'' is within the ordinary skill in the art. Other features of typical transducers such as insulating washers, wiring, electrical contacts etc. are well known to those of ordinary skill in the art and can be found in, for example, U.S. Pat. No. 3,309,654 to Miller.

The solid lines of the stress rods 6' and 6'' in FIG. 3(*a*) indicate the rods 6' and 6'' are fixed to the respective head masses 3' and 3'' and to the center mass 9. However, it is possible, to have a single stress rod connecting the two head masses 3' and 3'' and passing through a hole in the center mass 9. The extension of the single rod through the center mass 9 is illustrated by the dashed lines in FIG. 3(*a*).

The simplified equivalent circuit representation for the transducer of FIG. 3(*a*) is shown in FIG. 3(*b*). This circuit includes two piezoelectric stacks, each of which is represented by the combination of the equivalent electrical components $C_0$, $C_1$, $C_2$, $m_1$, $m_2$, $m_{e1}$, $m_{e1}$ and the electromechanical transformer whose transformation ratio is $\phi$. The equivalent inductor $m_c$ in the circuit represents the center mass 9.

The equivalent circuit of FIG. 3(*b*) makes it evident that the transducer device of FIG. 3(*a*) may be viewed and analyzed as a two input, two output linear system. If the device is used as a transmitting transducer, the input parameters are the voltage $E_1$ and $E_2$ at the electrical connections to the two ceramic stacks 2, and the output parameters are the velocities $u_1$ and $u_2$ of the two radiating head masses 3.

Analysis methods for this two-input, two-output system are similar to those for the simpler prior art devices.

Figure 2A:
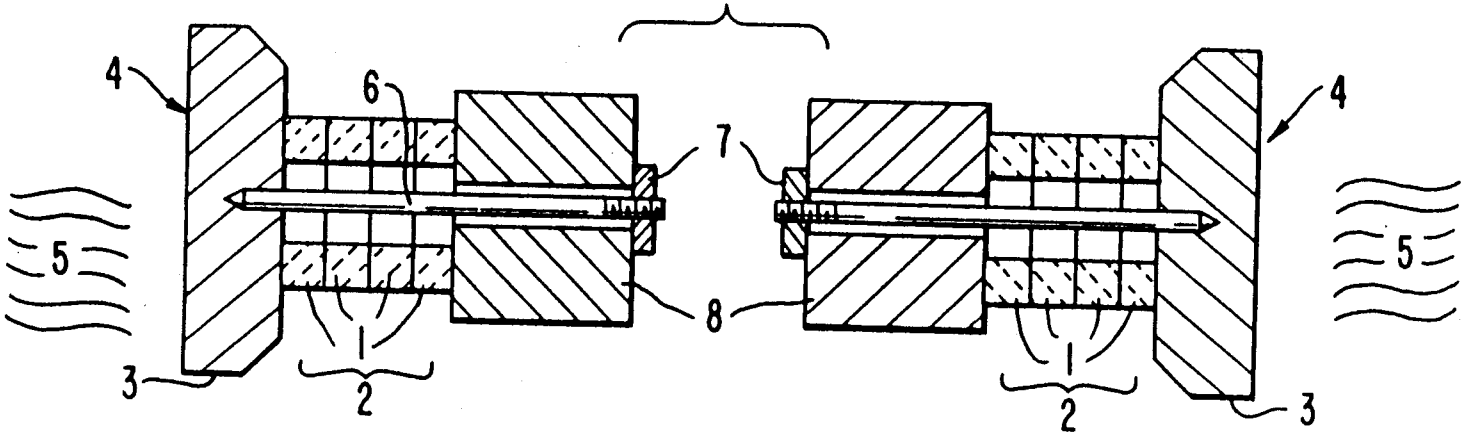
FIG. 2(*a*) depicts, in longitudinal cross section, the elements and construction of a pair of prior art longitudinal vibrator transducers capable of independent radiation in two directions along their common longitudinal axis.
Figure 2B:
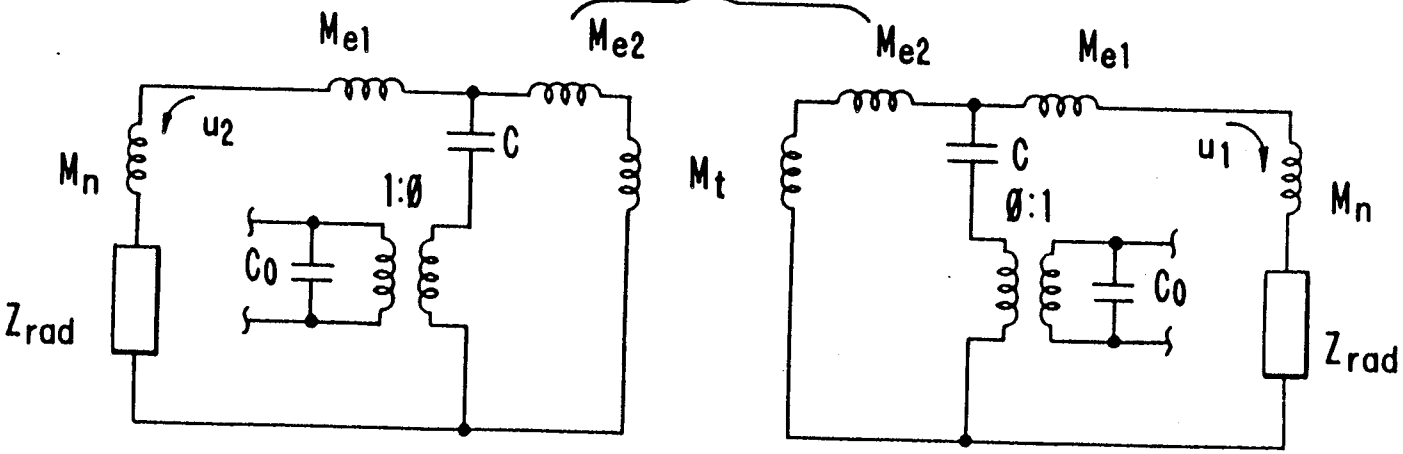
Figure 3A:
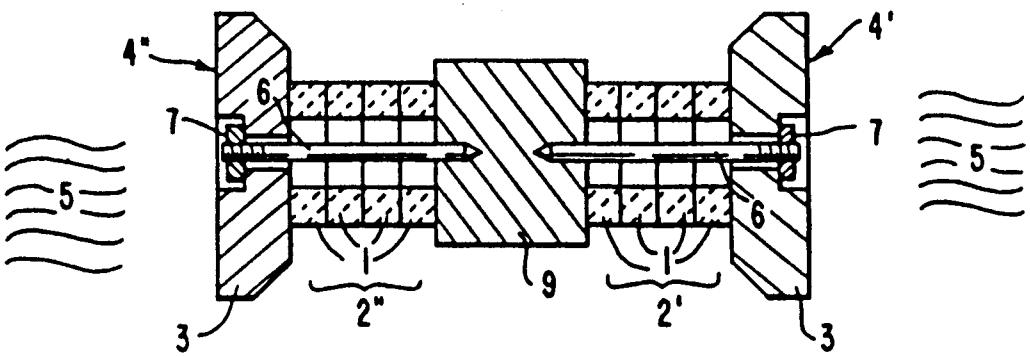
FIG. 3(*a*) depicts, in longitudinal cross section, the elements and construction of a transducer according to the present invention.
Figure 3B:
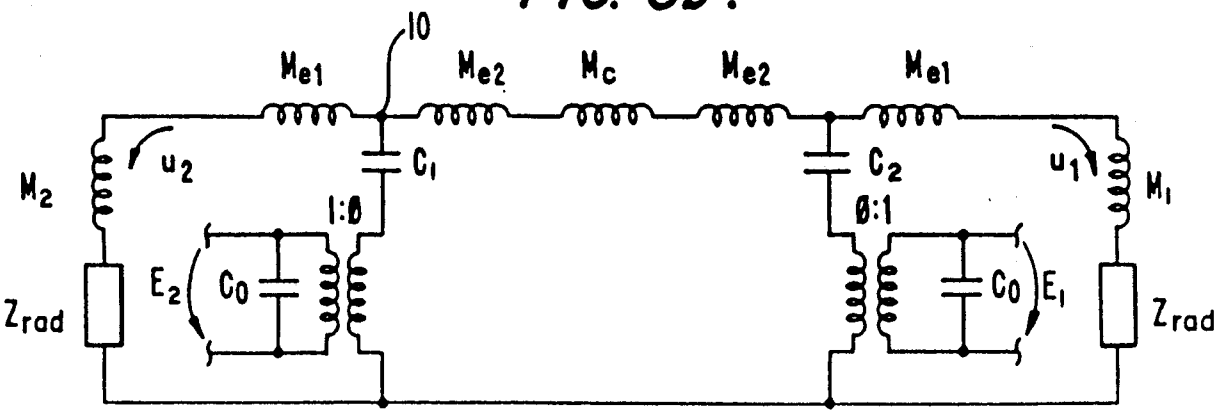
Figure 3C:
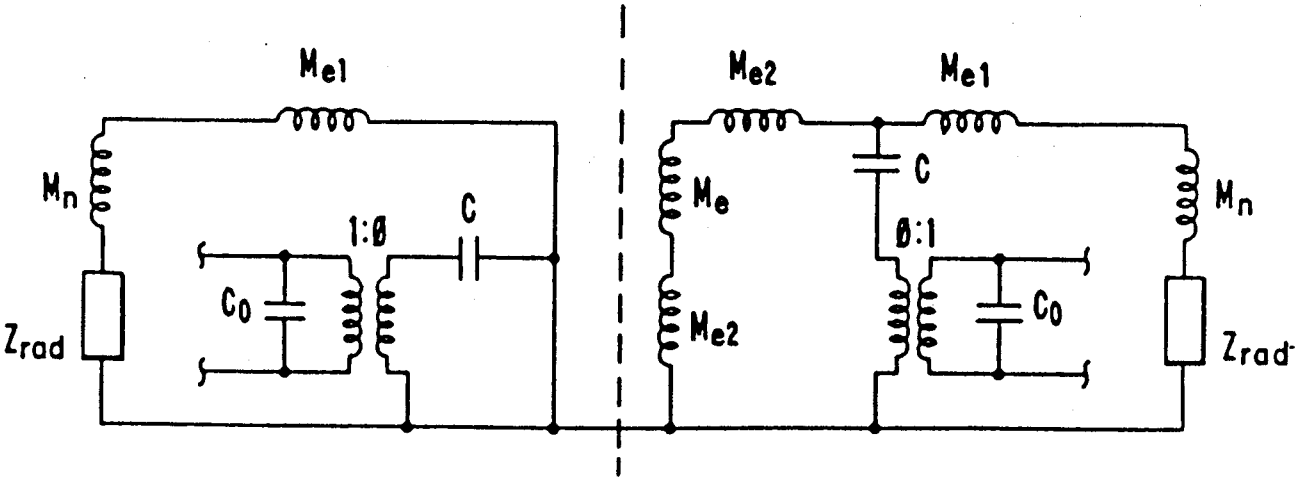

For example, it is well known that the radiation u of one of the transducers in FIG. 2(*a*) is proportional to the driving voltage E, as u=CE. For the device of the present invention, the velocity of each head mass is a linear function of each of the two electrical port voltages:

$$u_1 = C_{11}E_1 - C_{12}E_2$$

$$u_2 = C_{21}E_1 - C_{22}E_2 \quad (1)$$

This method of analysis as well as transfer matrix methods of performing the analysis discussed above, are well-known in the transducer industry, as discussed in, for example, Leon Camp, "Underwater Acoustics", Riley & Sons, New York, 1970, pp. 142–150; and Berlincourt et al., "Piezoelectric and Piezomagnetic Materials and their Function in Transducers", *Physical Acoustics*, Vol. 1A, Academic Press, New York, 1964, pp. 246–253. More complete and accurate performance predictions for transducers can be obtained by using a computer model that uses transfer matrices, such as described in "Computerized Sonar Transducer Analysis And Design Based On Multi-port Network Interconnection Techniques" by H. H. Ding et al, published as Report No. NUC TP228 by the Naval Undersea Center, San Diego, Calif., 1973.

where $u_1$ and $u_2$ are the velocities of head masses 3' and 3" respectively, and $E_1$ and $E_2$ are the drive voltages applied to ceramic stacks 2' and 2", respectively, and $C_{11}$–$C_{22}$ represent transfer matrix elements. The transfer elements $C_{11}$–$C_{22}$ are determined as follows:

$$C_{11} = \frac{jwm_1'iC_1}{M_TD}\left(1 - w^2\frac{m_2'm_c'}{m_2'm_c'}C_2\right) \quad (2)$$

$$C_{12} = \frac{jwm_2'C_2}{M_TD} \quad (3)$$

$$C_{21} = \frac{jwm_1'C_1}{M_TD} \quad (4)$$

$$C_{22} = \frac{jwm_2'C_2}{M_TD}\left(1 - w^2\frac{m_1'm_c'}{m_1'm_c'}C_1\right) \quad (5)$$

where $$m_1' = m_1 - m_{e1} \quad (6)$$

$$m_2' = m_2 - m_{e1} \quad (7)$$

$$m_c' = m_c - 2m_{e2} \quad (8)$$

$$M_T = m_1' - m_2' - m_e' \quad (9)$$

$$D = 1 - w^2C_1\frac{m_1'(m_2' + m_c')}{M_T} - w^2C_2\frac{m_2'(m_1' + m_c')}{M_T} + w^4\frac{m_1'm_2'm_c'}{M_T} \quad (10)$$

w is the angular frequency of operation and w=2@f where f is the operating frequency.

The variables $C_{11}$–$C_{22}$ in equations (1)–(10) are complex numbers which carry both amplitude and phase information. Details concerning the manipulation of such complex numbers in a matrix format can be found in *Foundations of Acoustics* by Eugen Skudrzyk, published in 1971 by Springer—Verlag of Wein Austria and New York.

Given any desired values for the radiating head velocities equation (1) allows the calculation of the two complex stack voltages which will produce them. In order to constrain $u_2$ to zero, these equations can readily be used to show that the required ratio of drive voltages is $$\frac{E_2}{E_1} = \frac{-C_{21}}{C_{22}} \quad (11)$$

The voltage ratio in equation (11) provides high power acoustic radiation from the head mass 3' and no radiation from the head 3". In a similar manner, equation (1) may be used to provide high radiation from head 3" and no radiation for head 3' with an applied voltage ratio of $$\frac{E_1}{E_2} = \frac{-C_{12}}{C_{11}} \quad (12)$$

With the voltage ratio selected according to equation (1) to provide zero velocity $u_2$ to the element head mass 3", the circuit node 10 in FIG. 3(*b*) is held at zero equivalent voltage. As a consequence, the dynamic situation is identical to that shown in FIG. 3(*c*) where the virtual ground point 10 in FIG. 3(*b*) is redrawn to explicitly show its ground potential. The portion of FIG. 3(*c*) to the right of the dotted line is identical to one of the equivalent circuits of the conventional transducer shown in FIG. 2(*b*) with the exception that the equivalent tail mass $m_t$ in FIG. 2(*b*) is replaced by the combination of the equivalent center mass $m_c$ and the equivalent mass of the ceramic $m_{e2}$. Consequently, the electrical, mechanical, and acoustical behavior of the right half of FIG. 3(*c*) is identical to that of a conventional element in FIG. 2. Significant acoustic energy is radiated from head mass 3' just as would be the case for a conventional element. By changing the drive voltage ratio from that in equation (11) to that of equation (12) it is possible to change the direction of the radiation without moving the transducer device.

In fact it is possible to adjust the relative drive voltages to the two piezoelectric stacks to provide any relative radiation ratio between the left and right directions from the maximum rightward ratio (equation 11) described above, through equal radiation produced by both sides, and finally to the maximum leftward radiation ratio (equation 12) described above. If we let $$r = \frac{u_1}{u_2} \quad (13)$$

be the desired ratio of the radiating velocities of the two head masses, then the required drive voltage ratio to create this situation can be determined from equation (1) to be $$\frac{E_1}{E_2} = \frac{C_{22}r - C_{21}}{-C_{12}r + C_{11}} \quad (14)$$

For a device which possesses reflective symmetry about the center mass, the electroacoustic transfer matrix elements are related by $$C_{11} = C_{22} \quad (15)$$

$$C_{21} = C_{12}$$

For unidirectional radiation in which $u_1$ is zero, $r=0$ and equation (14) reduces to equation (12). For unidirectional radiation with $u_2$ as it approaches zero, equation (14) reduces to equation (11). For equal radiation from the two heads, $r=1$ in equation (14) and hence $E_1=E_2$.

Figure 4:
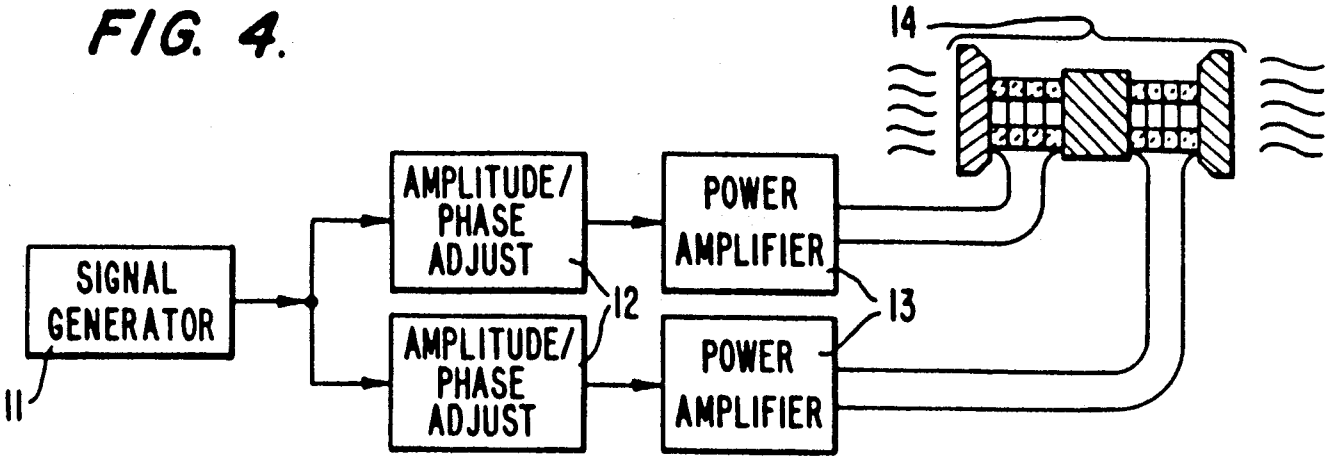
FIG. 4 illustrates an electrical circuit suitable for operating the transducer of the present invention as a unidirectional transmitter.

FIG. 4 shows a representative configuration for the transducer and driving electronics to provide the performance possibilities discussed above. This figure shows an electrical signal generator 11 which provides the system input. This signal is sent through the independent channels of gain and phase adjustment units 12 which adjust the amplitude and phase of the input signal in accordance with the desired complex drive voltage E for each channel. The complex drive voltages are applied to power amplifiers 13, amplified and then applied to the two piezoelectric stacks of the transducer 14 of FIG. 3(*a*). By properly selecting the amplitude and phase adjustment in the two channels, as described previously, it is possible to vary the performance of the system throughout the range of possibilities.

Figure 5:
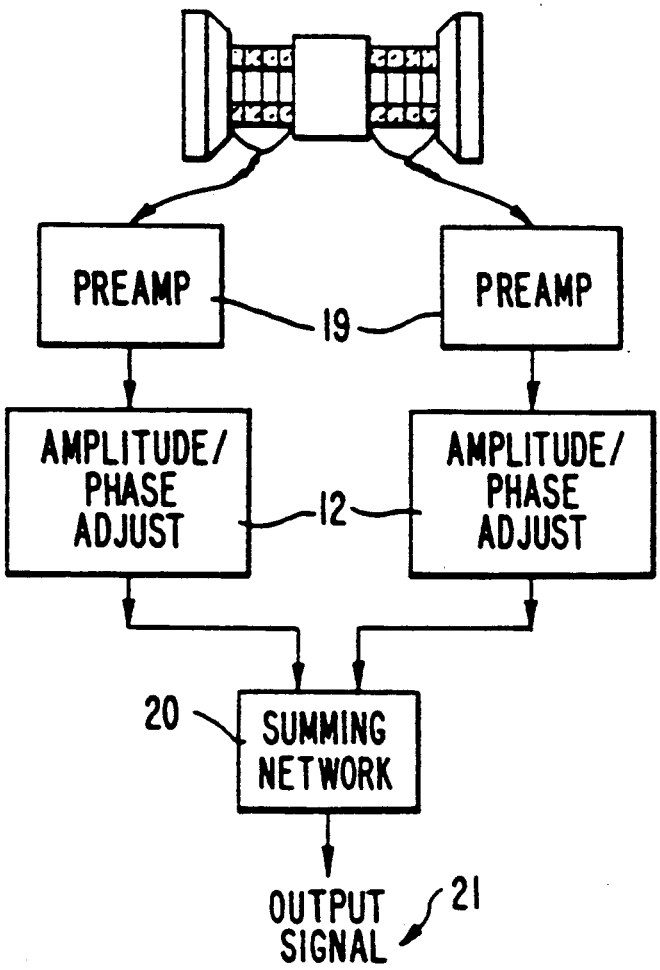
FIG. 5 shows an electrical circuit suitable for operating the transducer of the present invention as a unidirectional receiver.

FIG. 5 is an example of the use of the new device as a receiving sensor. The electrical signals produced in the two piezoelectric stacks are buffered and amplified by separate preamplifiers 19. The preamp output signals are than fed to separate gain and phase adjustment circuitry whose effect on the signals can be manually or automatically adjusted to provide the proper directional response for the system in accordance with equation (1). These signals are then added together in a summing circuit 20 to provide a final output signal 21 having the desired directional sensitivity.

All of the preceding discussion has explicitly assumed that the transducer device is symmetric about the center mass 9. When the transducer is symmetric about the center mass 9 the center mass 9 should be at least as massive as one of the head masses 3' or 3''. When unbalanced head masses 3' and 3'' are used, the center mass 9 should be as massive as the most massive of the head masses 3' and 3''. An additional alternative embodiment of the present invention can achieve further performance enhancement in some applications by providing somewhat different dimensions and/or materials for the left and right transducer elements. The effect of such modifications can be determined by substituting the desired values into equation (1) as represented by FIG. 3(*b*). Modifications of this type could allow the rightward and leftward radiation to be optimized for somewhat different operating frequency bands, and thus increase the total operating bandwidth of the transmitting system.

The prior art methods of electrical stack termination, the use of impedance matching layers on the radiating faces, and the use of resonant head mass structures, as described in pending U.S. Pat. Application No. 626,784 (by the present inventor and assigned to the assignee of the present application), are all compatible with the present invention and may advantageously be used in conjunction therewith, as will be recognized by those skilled in the art.

The many features and advantages of the present invention are apparent from the detailed specification and thus it is intended by the appended claims to cover all such features and advantages of the device which fall within the true spirit and scope of the invention. Further, since numerous modifications and changes will readily occur to those skilled in the art, it is not desired to limit the invention to the exact description and operation illustrated and described, and accordingly, all suitable modifications and equivalents may be resorted to falling within the scope of the invention.

I claim:

1. A double mass loaded transducer, comprising:

first and second head masses in contact with an acoustic medium;

first and second independently drivable active transducer elements respectively abutting said first and second head masses; and center mass means, abutting said first and second transducer elements, for transferring vibration between said first and second transducer elements, and allowing vibration by one of said first or second head masses to be enhanced or nullified by the vibration of the other of said first or second head masses.

2. A transducer as recited in claim 1, wherein said first and second head masses are of unequal mass.

3. A transducer as recited in claim 1, wherein said first and second active transducer elements comprise different active transducer materials.

4. A double mass loaded transducer, comprising:

first and second head masses in contact with an acoustic medium;

first and second independently drivable active transducer elements respectively abutting said first and second head masses;

a center mass abutting said first and second transducer elements, transferring vibration between said first and second transducer elements, and allowing vibration by one of said first or second head masses to be enhanced or nullified by the vibration of the other of said first or second head masses; and drive means, electrically connected to said first and second active transducer elements, for independently driving said first and second active transducer elements with an amplitude and phase relationship therebetween.

5. A transducer, comprising:

a first head mass in contact with an acoustic medium;

a first independently drivable active transducer element abutting said first head mass;

a center mass abutting said first active transducer element;

a second independently drivable active transducer element abutting said center mass;

a second head mass abutting said second active transducer element and in contact with the acoustic medium; and drive means for selectively and independently driving said first and second transducer elements.

6. A transducer as recited in claim 5, wherein said drive means drives said first and second active transducer elements with variable amplitude and phase drive voltages therebetween.

7. A transducer as recited in claim 5, further comprising receive means, electrically connected to said first and second active transducer elements, for amplifying, varying the phase of and summing voltages produced by said first and second active transducer elements.

8. A transducer as recited in claim 5, further comprising:

a fixed stress rod connected between said first head mass and said center mass; and a second stress rod connected between said second head mass and said center mass.

9. A transducer as recited in claim 5, wherein said center mass has a hole therethrough and said transducer further comprises a stress rod connected between said first and second head masses through the hole in said center mass.

10. A radiation direction selectable transducer, comprising:

a first head mass in contact with an acoustic medium;

a first independently drivable active transducer element abutting said first head mass;

a center mass abutting said first transducer element;

a second independently drivable active transducer element abutting said center mass;

a second head mass abutting said second transducer element and in contact with the acoustic medium; and drive means for independently driving said first and second active transducer elements with an amplitude and phase relationship therebetween.

11. A pick-up direction selectable transducer, comprising:

a first head mass in contact with an acoustic medium;

a first independently drivable active transducer element abutting said first head mass and producing a first output when driven;

a center mass abutting said first transducer element;

a second independently drivable active transducer element abutting said center mass and producing a second output when driven;

a second head mass abutting said second transducer element and in contact with the acoustic medium; and receive means, coupled to said first and second transducer elements, for independently amplifying and varying the phase of the first and second outputs and summing the amplified and phase varied first and second outputs.

* * * * *